US010559415B2

(12) United States Patent
Chuang

(10) Patent No.: US 10,559,415 B2
(45) Date of Patent: Feb. 11, 2020

(54) COMMON MODE FILTER CAPABLE OF BALANCING INDUCED INDUCTANCE AND DISTRIBUTED CAPACITANCE

(71) Applicant: CYNTEC CO., LTD., Hsinchu (TW)

(72) Inventor: Chia-Cheng Chuang, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 53 days.

(21) Appl. No.: 15/882,992

(22) Filed: Jan. 29, 2018

(65) Prior Publication Data

US 2019/0237243 A1 Aug. 1, 2019

(51) Int. Cl.

| | |
|---|---|
| ***H01F 27/29*** | (2006.01) |
| ***H01F 27/28*** | (2006.01) |
| ***H01F 27/24*** | (2006.01) |

(52) U.S. Cl.

CPC ..... *H01F 27/2823* (2013.01); *H01F 27/24* (2013.01); *H01F 27/29* (2013.01)

(58) Field of Classification Search

CPC ..... H01F 27/00–36

USPC ..... 336/65, 83, 170–173, 180–184, 200, 336/220–223, 232

See application file for complete search history.

(56) References Cited

U.S. PATENT DOCUMENTS

| | | | | |
|---|---|---|---|---|
| 9,362,041 | B2 | 6/2016 | Tomonari | |
| 9,659,701 | B2 | 5/2017 | Tomonari | |
| 9,767,953 | B2 * | 9/2017 | Fan | H01F 27/2828 |
| 2013/0076472 | A1 | 3/2013 | Pan | |
| 2017/0069418 | A1 * | 3/2017 | Yamakita | H01F 41/069 |
| 2017/0288626 | A1 | 10/2017 | Kobayashi | |
| 2018/0211763 | A1 * | 7/2018 | Komaya | H01F 17/045 |
| 2019/0237243 | A1 * | 8/2019 | Chuang | H01F 27/24 |

FOREIGN PATENT DOCUMENTS

| | | |
|---|---|---|
| CN | 103887040 B | 4/2017 |
| TW | M494997 U | 2/2015 |

* cited by examiner

*Primary Examiner* — Tuyen T Nguyen
(74) *Attorney, Agent, or Firm* — Winston Hsu

(57) ABSTRACT

A common mode filter includes an inner coil and an outer coil. The inner coil is formed of an inner wire and includes a plurality of inner turns. The outer coil is formed of an outer wire and includes a plurality of outer turns and at least one cross turn. A sum of the plurality of outer turns and the at least one cross turn is equal to a number of the plurality of inner turns, and the at least one cross turn comprises a N-th turn of the outer coil wound across a (N−1)th turn of the outer coil, and adjacent to two of the plurality of turns of the outer coil.

20 Claims, 14 Drawing Sheets

COMMON MODE FILTER CAPABLE OF BALANCING INDUCED INDUCTANCE AND DISTRIBUTED CAPACITANCE

BACKGROUND OF THE INVENTION

1. Field of the Invention

The present invention relates to a common mode filter, and more particularly, to a common mode filter capable of balancing induced inductance and distributed capacitance.

2. Description of the Related Art

A common mode filter (e.g., a common mode choke (CMC)) is provided to transmit an input signal with a pair of differential signals using a differential transmission method, to selectively remove only a common mode noise of the input signal. The common mode filter is configured with two coils wound on a single core, and magnetic fields produced by differential currents in the windings tend to cancel each other out. Thus, the common mode filter is useful for prevention of electromagnetic interference (EMI) and radio frequency interference (RFI) due to the common mode current.

Mode conversion of the common mode filter refers to the inputted signal being converted from one mode into another mode, which may be common mode to differential mode or differential mode to common mode. As the name implies, a part of the inputted signal (including transmitted signal and interfere signal) is converted from common mode to differential mode to produce differential mode noise, while another part of the inputted signal is converted from differential mode to common mode to produce common mode noise.

Regarding the characteristic of mode conversion from common mode to differential mode, most of the interfere signal appears to be a common mode noise; when the common mode noise is inputted into the common mode filter, a part of the common mode noise is converted into a differential mode noise to be mixed with the transmitted signal, which decreases the signal-to-noise ratio and increases the error rate during signal processing.

Regarding the characteristic of mode conversion from differential mode to common mode, the transmitted signal is a pair of differential signals, and a part of the transmitted signal is converted into the common mode noise to be mixed with the differential signals, which decreases the signal-to-noise ratio and increases the error rate during signal processing. Further, the common mode noise converted from the transmitted signal probably becomes an EMI radiation source.

FIG. 1A illustrates a perspective view of an exterior structure of a common mode filter 1 in the prior art. The common mode filter 1 includes a winding core 11, a plate core 12, terminal electrodes E1, E2, E3 and E4, flanges F1 and F2, and wires W11 and W12. An integration of the winding core 11, the terminal electrodes E1, E2, E3 and E4, and the flanges F1 and F2 are also known as a drum core.

The wire W11 is wound around the winding core 11, one end of the wire W11 is electrically connected to the electrode E1, and the other end of the wire W11 is electrically connected to the electrode E3. The wire W12 is wound around the winding core 11 and the wire W11, one end of the wire W12 is electrically connected to the electrode E2, and the other end of the wire W12 is electrically connected to the electrode E4. A pair of differential signals is respectively transmitted by the wires W11 and W12 from the terminal electrodes E1 and E2 to the terminal electrodes E3 and E4.

FIG. 1B illustrates a cross-sectional view of the common mode filter 1. The wires W11 and W12 are wound around the winding core 11 with a same number (e.g., 9) of turns, there are turns B1-B9 wound by the wire W11, and there are turns A1-A9 wound by the wire W12.

There are two effects that lead to the mode conversion with common mode filter 1: One is the difference of inductances of wire 11 and 12, and the other is the imbalance of capacitive couplings.

To demonstrate the mode conversion caused by the difference of inductances of wire W11 and W12, refer to conduction routes of magnetic fluxes induced by the two wires. FIG. 1C illustrates the conduction routes over a cross-sectional view of the common mode filter 1. When a signal flows through wire W11 or W12, magnetic flux is induced both inside and outside the cores. A major part of the magnetic flux is induced along a route inside the cores since magnetic material tends to draw magnetic flux under magnetic field in nature. A minor part of the magnetic flux is conducted along a close route outside the cores, particularly in the space enclosed by the plate and drum cores. Then a total flux refers to the sum of the major and minor parts of magnetic flux. The inner turns B1-B9 wound by the wire W11 induce its minor part of magnetic flux along route FLUX_B. The outer turns A1-A9 wound by the wire W12 induce its minor part of magnetic flux along route FLUX_A. As observed from FIG. 1C, since the inner turns B1-B9 are closer to winding core 11, the major part of magnetic flux induced by wire 11 is greater than the major part of magnetic flux induced by wire 12. On the contrary, as regarding the minor part of magnetic fluxes induced outside the cores, particularly in the space enclosed by the plate and drum cores, the minor part of the magnetic flux conducted along route FLUX_B is less than the minor part of magnetic flux conducted along route FLUX_A. As regarding the total magnetic flux, wire W11 induces a greater total magnetic flux than W12 induces so that W11 performs a higher inductance than W12 performs. According to Faraday's law of electromagnetic induction, when a common mode noise current flows through wire W11 and W12, wire W11 can generates a stronger electromotive force (EMF) than wire 12 generates, making different electrical potentials on the two wires. Then the potential difference drives an electrical current coupled from one wire to the other, which is deemed as a differential mode noise current converted from the common mode noise current. As a result, the difference of inductances of wire W11 and W12 makes the characteristic of mode conversion significant. The above describes the mode conversion problem raised by the effect of inductance difference characterized with two lumped inductances for wire W11 and W12.

The following describes the mode conversion raised by the imbalance of capacitive couplings among distributed inductances and capacitances for wire W11 and W12. FIG. 1D illustrates an equivalent circuit diagram of the common mode filter 1. Again according to Faraday's law of electromagnetic induction, different electrical potentials are induced in turns of a coil when a current flows into the coil, and these electrical potentials can be described by different distributed capacitances. For example, there are distributed capacitances C_A(i−1)_Bi and C_Ai_Bi produced by the coils wound by the wires W11 and W12, e.g., capacitances C_A1_B2, C_A2_B3, C_A3_B4, C_A4_B5, C_A5_B6, C_A7_B8, C_A8_B9, C_A1_B1, C_A2_B2, C_A3_B3, C_A4_B4, C_A5_B5, C_A6_B6, C_A7_B7, C_A8_B8, and C_A9_B9. The inner turns Bi of the inner coil may be described as distributed inductance L_Bi, i.e., inductances L_B1-L_B9. The outer turns Ai of the outer coil may be described as inductance L_Ai, i.e., inductances L_A1-L_A9.

To describe the effect of imbalance of capacitive couplings, assume that the distributed inductances, L_Ai and L_Bi, are equal to each other so wire W11 and W12 perform a same lumped inductance. Then there is no electrical potential difference between the distributed capacitances C_Ai_Bi given by a common mode noise signal, which produces equal currents flowing through wire W11 and W12 and ideally no current coupled through the distributed capacitances C_Ai_Bi; however, there are electrical potential differences across the distributed capacitances C_A(i−1) Bi to drive coupling currents being mixed with an input signal. As observed from FIG. 1D, the coupling currents produced by the distributed capacitances C_A(i−1)_Bi cause phase shifts with a same direction to the input signal, wherein the phase shift is associated with a difference between the serial numbers of the turns B1-B9 and A1-A9, and a total phase shift is a summation of each of the difference between the serial numbers of the turns B1-B9 and A1-A9. In practice, the input signal is mixed with the coupling current with the total phase shift to be outputted by the common mode filter 1, which makes the characteristic of mode conversion significant.

Therefore, how to provide a common mode filter capable of balancing induced inductance and distributed capacitance between the windings has become a topic in the industry.

SUMMARY OF THE INVENTION

It is therefore an objective of the present invention to provide a common mode filter capable of balancing induced inductance and distributed capacitance between the windings.

The present invention discloses a common mode filter including a winding core, an inner coil and an outer coil. The inner coil is formed of an inner wire wound around the winding core, and includes a plurality of inner turns. The outer coil is formed of an outer wire wound around the inner coil, and includes a plurality of outer turns and at least one cross turn. A sum of the plurality of outer turns and the at least one cross turn is equal to a number of the plurality of inner turns, and the at least one cross turn comprises a N-th turn of the outer coil wound across a (N−1)th turn of the outer coil, and adjacent to two of the plurality of outer turns of the outer coil, wherein N is an integer not less than 3 and not greater than the number of the plurality of inner turns.

The present invention further discloses a common mode filter including a winding core, an inner coil, and an outer coil. The inner coil is formed of an inner wire wound around the winding core, and includes a plurality of inner turns. The outer coil is formed of an outer wire wound around the inner coil, and includes a plurality of outer turns and at least one cross turn, wherein a sum of the plurality of outer turns and the at least one cross turn is equal to a number of the plurality of inner turns. The at least one cross turn includes a N-th turn of the outer coil, wound across one of the plurality of outer turns of the outer coil, and is adjacent to two of the plurality of outer turns of the outer coil. The N-th turn includes a back-crossing portion, the back-crossing portion contacts with a surface of the outer turn, and the surface of the outer turn is away from the inner coil, wherein N is an integer not less than 3 and not greater than the number of inner turns.

The present invention further discloses a common mode filter including a winding core, an inner coil, and an outer coil. The inner coil is formed of an inner wire wound around the winding core, and includes a plurality of inner turns. The outer coil is formed of an outer wire wound around the inner coil, and includes a plurality of outer turns and at least one cross turn. A sum of the plurality of outer turns and the at least one cross turn is equal to a number of the plurality of inner turns, and the at least one cross turn is adjacent to two of the plurality of outer turns that are wound before the at least one cross turn is wound.

These and other objectives of the present invention will no doubt become obvious to those of ordinary skill in the art after reading the following detailed description of the preferred embodiment that is illustrated in the various figures and drawings.

DETAILED DESCRIPTION

Figure 2A:
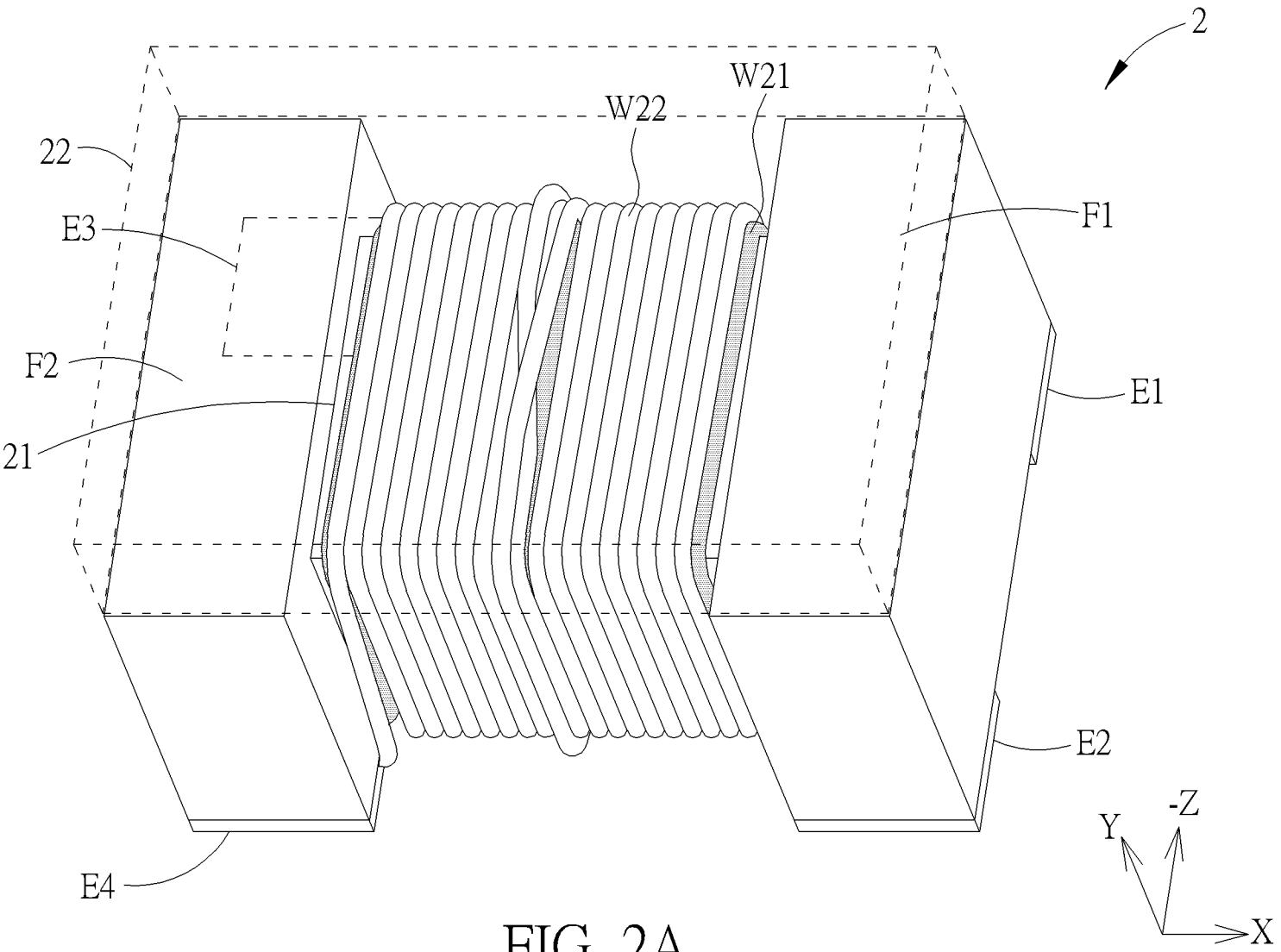
FIG. 2A illustrates a perspective view of an exterior structure of a common mode filter according to an embodiment of the present invention.

FIG. 2A illustrates a perspective view of an exterior structure of a common mode filter 2 according to an embodiment of the present invention. The common mode filter 2 includes a winding core 21, a plate core 22, terminal electrodes E1, E2, E3 and E4, flanges F1 and F2, and wires W21 and W22. An integration of the winding core 21, the terminal electrodes E1, E2, E3 and E4, and the flanges F1 and F2 are also known as a drum core. The drum core, the winding core 21 and the plate core 22 are made of magnetic materials.

The wire W21 is wound around the winding core 21, one end of the wire W21 is electrically connected to the electrode E1, and the other end of the wire W21 is electrically connected to the electrode E3. The wire W22 is wound around the winding core 21 and the wire W21, one end of the wire W22 is electrically connected to the electrode E2, and the other end of the wire W22 is electrically connected to the electrode E4. An input signal with a pair of differential signals is respectively inputted to the wires W21 and W22 through the electrodes E1 and E2, and an output signal with a pair of differential signals is respectively outputted through the electrodes E3 and E4.

In one embodiment, the input signal with the pair of differential signals is respectively inputted to the wires W21 and W22 through the electrodes E3 and E4, and an output signal with a pair of differential signals is respectively outputted through the electrodes E1 and E2.

As observed from FIG. 2A, a projection of the outer turns A1-AM projected onto the winding core 21 (e.g., XZ plane) is smaller than a projection of the inner turns B1-BM onto the winding core 21. In other words, a minimum distance between the first outer turn A1 and the flange F1 is greater than a minimum distance between the first inner turn B1 and the flange F1, and a minimum distance between the last outer turn AM and the flange F2 is greater than a minimum distance between the last inner turn BM and the flange F2.

Figure 2B:
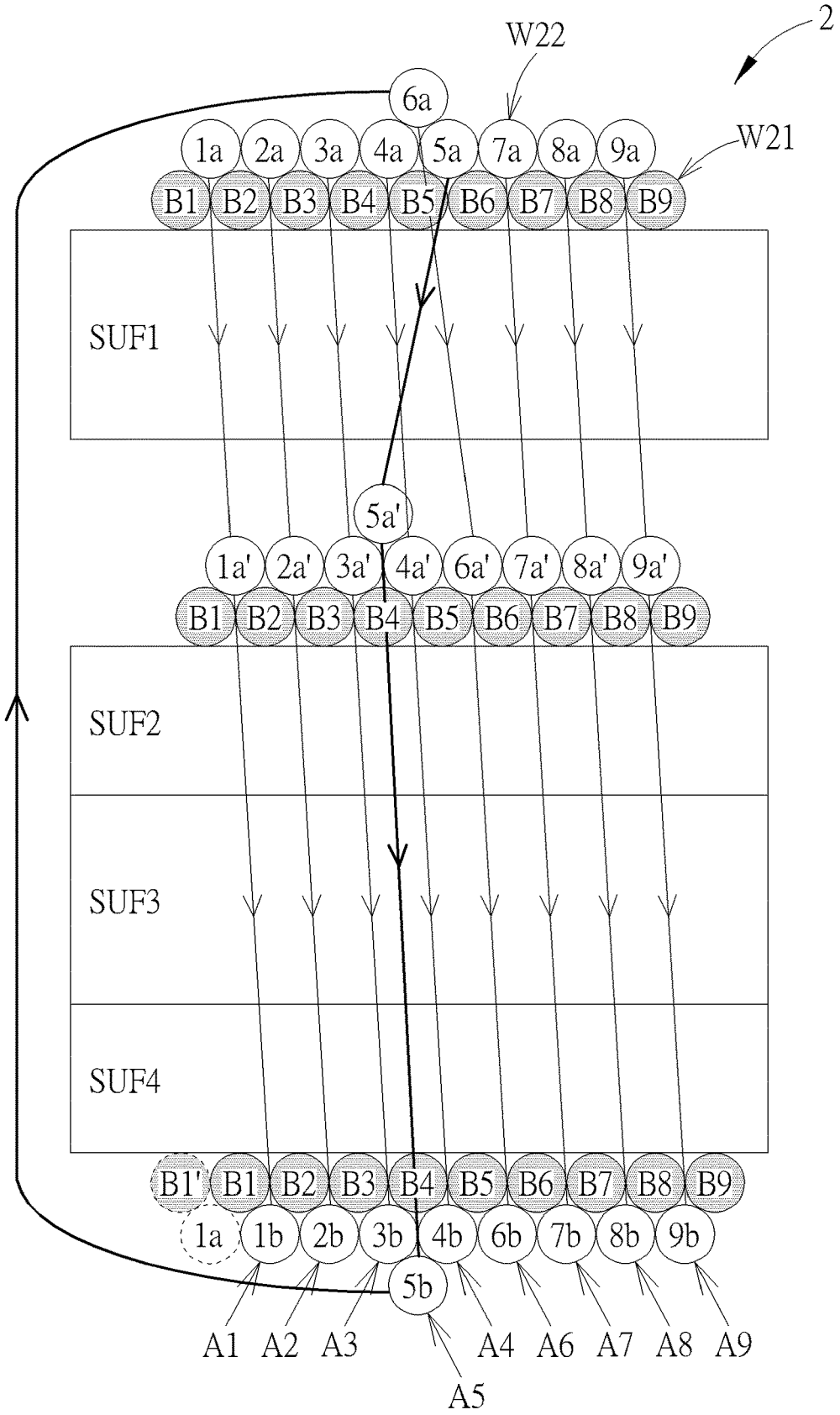
FIG. 2B illustrates a cross-sectional view of the common mode filter of FIG. 2A.

FIG. 2B illustrates cross-sectional views of the common mode filter 2. An inner coil is formed of the inner wire W21 wound around the winding core 21, and includes a plurality of inner turns B1-B9. An outer coil is formed of the outer wire W22 wound around the inner coil, and includes a plurality of outer turns A1-A4 and A6-A9, and at least one cross turn A5, wherein a sum of the plurality of outer turns A1-A4 and A6-A9 and the at least one cross turn A5 is equal to a number M of the plurality of inner turns B1-B9 (e.g., M=9). Note that an inlet portion B1' of the inner coil and an inlet portion 1*a* of the outer coil are denoted with dashed pattern.

The at least one cross turn comprises a N-th turn of the outer coil wound across a (N−1)th turn of the outer coil, and adjacent to two of the plurality of outer turns. N is an integer not less than 3 and not greater than the number of the plurality of inner turns. For example, given that N=5, the at least one cross turn comprises the fifth turn A5 of the outer coil wound across the fourth outer turn A4 of the outer coil, and adjacent to the outer turns A3 and A4.

The N-th turn comprises a back-crossing portion, the back-crossing portion contacts with a surface of the outer turn, and the surface of the outer turn contacting with the back-crossing portion is away from the inner coil. For example, the fifth turn A5 comprises a back-crossing portion 5*a*5*a*', the back-crossing portion 5*a*5*a*' contacts with a surface of the outer turn A4 (or a portion 4*a*4*a*' of the outer turn A4), and the surface of the outer turn A4 contacting with the back-crossing portion 4*a*4*a*' is away from the inner coil.

The plurality of outer turns comprises a (N+1)th turn of the outer coil, the (N+1)th turn of the outer coil comprises a front-crossing portion, the front-crossing portion wounds across the N-th turn of the outer coil and contacts with a surface of the N-th turn of the outer coil, and the surface of the N-th turn of the outer coil is away from the inner coil. For example, the sixth turn A6 of the outer coil comprises a front-crossing portion 6*a*6*a*', the front-crossing portion 6*a*6*a*' wounds across the fifth turn A5 and contacts with a surface of the fifth turn A5, and the surface of the fifth turn A5 is away from the inner coil.

The at least one cross turn includes a first portion across the (N−1)th turn of the outer coil, and a second portion parallel to the (N−1)th and (N−2)th turns of the outer coil, wherein the second portion is not adjacent to the inner turns, i.e., the second portion does not contact with the inner turns. The first portion includes one end connected to the (N−1)th turn of the outer coil and adjacent to the two of the inner turns, and another end adjacent to the (N−1) th and (N−2)th turns of the outer coil and not adjacent to the plurality of inner turns. The second portion includes one end connected to the first portion, and another end connected to (N+1)th turn of the outer coil.

For example, the at least one cross turn is the outer turn A5 of the outer coil, and includes a first portion 5*a*5*a*' across the outer turn A4 of the outer coil. The first portion 5*a*5*a*' includes one end 5*a* connected to the outer turn A4 of the outer coil and adjacent to the inner turns B5 and B6, and another end 5*a*' adjacent to the outer turns A3 and A4 of the outer coil and not adjacent to the plurality of inner turns B1-B9. The at least one cross turn A5 includes a second portion 5*a*'5*b* parallel to the outer turns A3 and A4 of the outer coil, not adjacent to the inner turns B1-B9, i.e., the second portion 5*a*'5*b* does not contact with the inner turns B1-B9. The second portion 5*a*'5*b* includes one end 5*a*' connected to the first portion 5*a*5*a*', and another end 5*b* connected to the outer turn A6 of the outer coil.

In one embodiment, the at least one cross turn is adjacent to two of the plurality of outer turns that are wound before the at least one cross turn is wound. The at least one cross turn includes a first portion across one of the plurality of outer turns that is wound before the at least one cross turn is wound, and a second portion parallel to two of the plurality of outer turns that is wound before the at least one cross turn is wound, and not adjacent to the inner turns. The first portion includes one end connected to one of the plurality of outer turns that is wound before the at least one cross turn is wound and adjacent to the two of the inner turns, and another end adjacent to two of the plurality of outer turns that is wound before the at least one cross turn is wound and not adjacent to the inner turns. The second portion includes one end connected to the first portion, and another end connected to one of the plurality of outer turns that is wound after the at least one cross turn is wound.

For example, the cross turn A5 is adjacent to the outer turns A3 and A4 that are wound before the cross turn A5 is wound. The cross turn A5 includes the first portion 5*a*5*a*' across the outer turn A4 that is wound before the cross turn A5 is wound, and the second portion 5*a*'5*b* parallel to the outer turns A3 and A4 that is wound before the cross turn A5 is wound, and not adjacent to the inner turns B1-B9. The first portion 5*a*5*a*' includes one end 5*a* connected to outer turn A4 that is wound before the cross turn A5 is wound and adjacent to the inner turns B5 and B6, and another end 5*a*' adjacent to the outer turns A3 and A4 that is wound before the cross turn A5 is wound and not adjacent to the inner turns B1-B9. The second portion 5*a*'5*b* includes one end 5*a*' connected to the first portion 5*a*5*a*', and another end 5*b* connected to the outer turn A6 that is wound after the cross turn A5 is wound.

The winding core 21 may be a cuboid and formed with surfaces SUF1, SUF2, SUF3 and SUF4. In the embodiment of FIG. 2B, the first portion 5*a*5*a*' is wound across the outer turn A4 of the outer coil on the surface SUF1. In another embodiment, the first portion 5*a*5*a*' is wound across the outer turn A4 of the outer coil on one of the surface SUF1, SUF2, SUF3 and SUF4. In another embodiment, if the winding core 21 is a tube formed with one surface, the first portion 5*a*5*a*' is wound across the outer turn A4 of the outer coil on arbitrary location on the surface of the winding core 21 with tube-shape.

In one embodiment, given that there is only one cross turn and it is the N-th turn of the outer coil, wherein $$N = \left(\frac{M+1}{2}\right)$$

if M is odd, and M is the number of the plurality of outer turns of the outer coil. For example, the at least one cross turn is the fifth turn A5 of the outer coil if M is nine, wherein N=(9+1)/2=5. In other words, the cross turn is a middle turn of the outer coil.

Figure 1A:
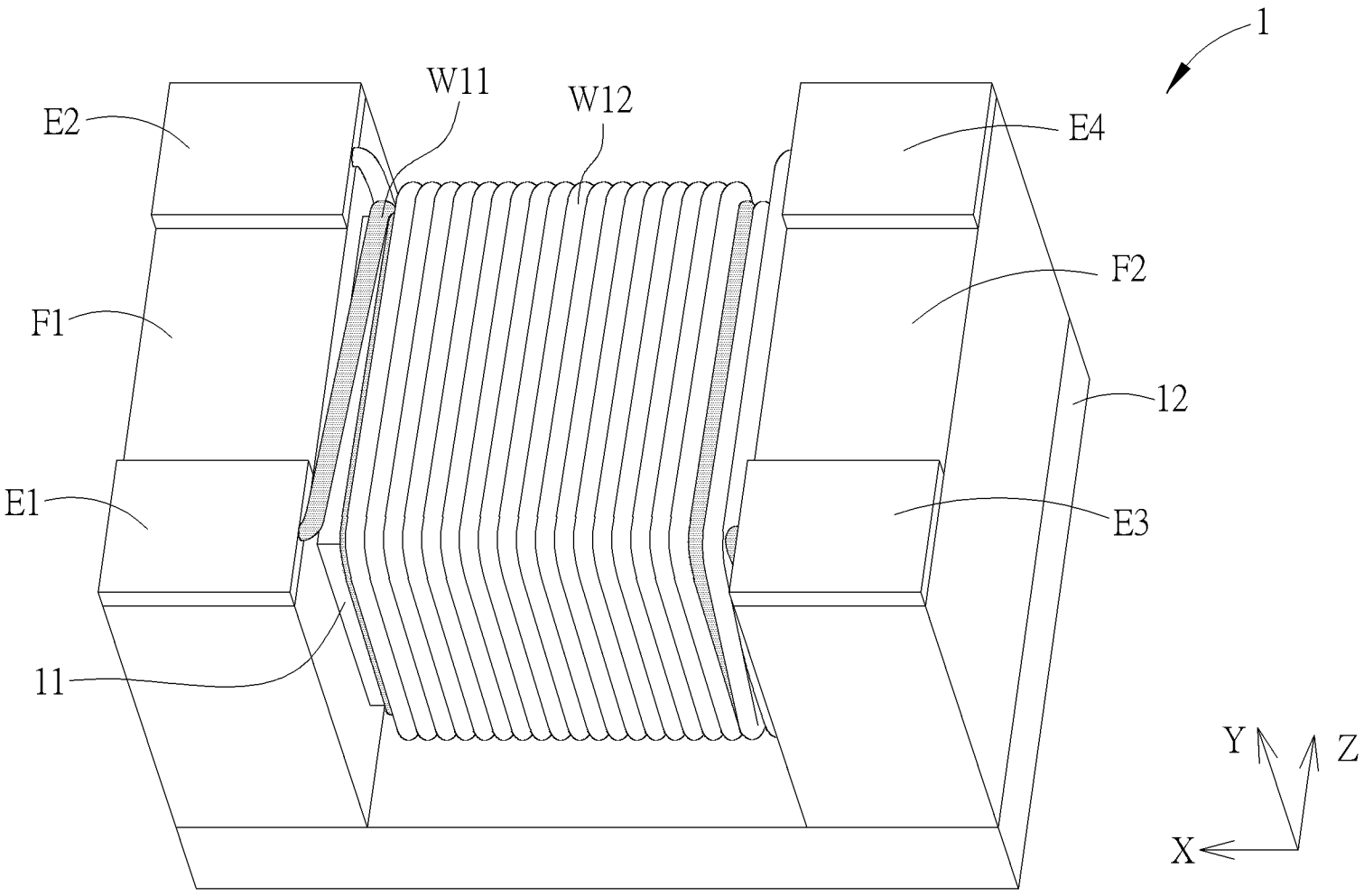
FIG. 1A PRIOR ART
FIG. 1A illustrates a perspective view of an exterior structure of a common mode filter in the prior art.
Figure 1B:
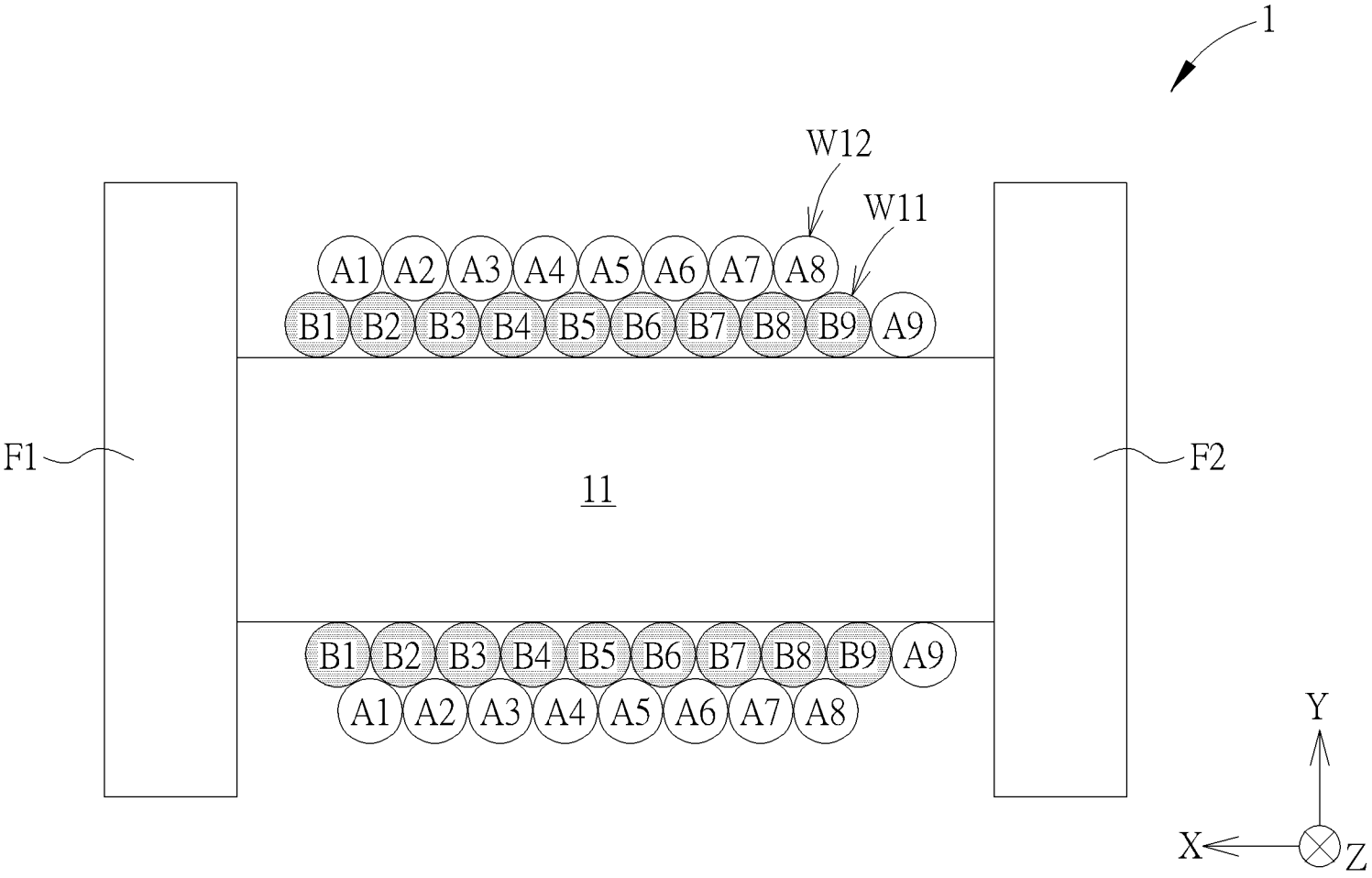
FIG. 1B PRIOR ART
FIG. 1B illustrates a cross-sectional view of the common mode filter of FIG. 1A.
Figure 1C:
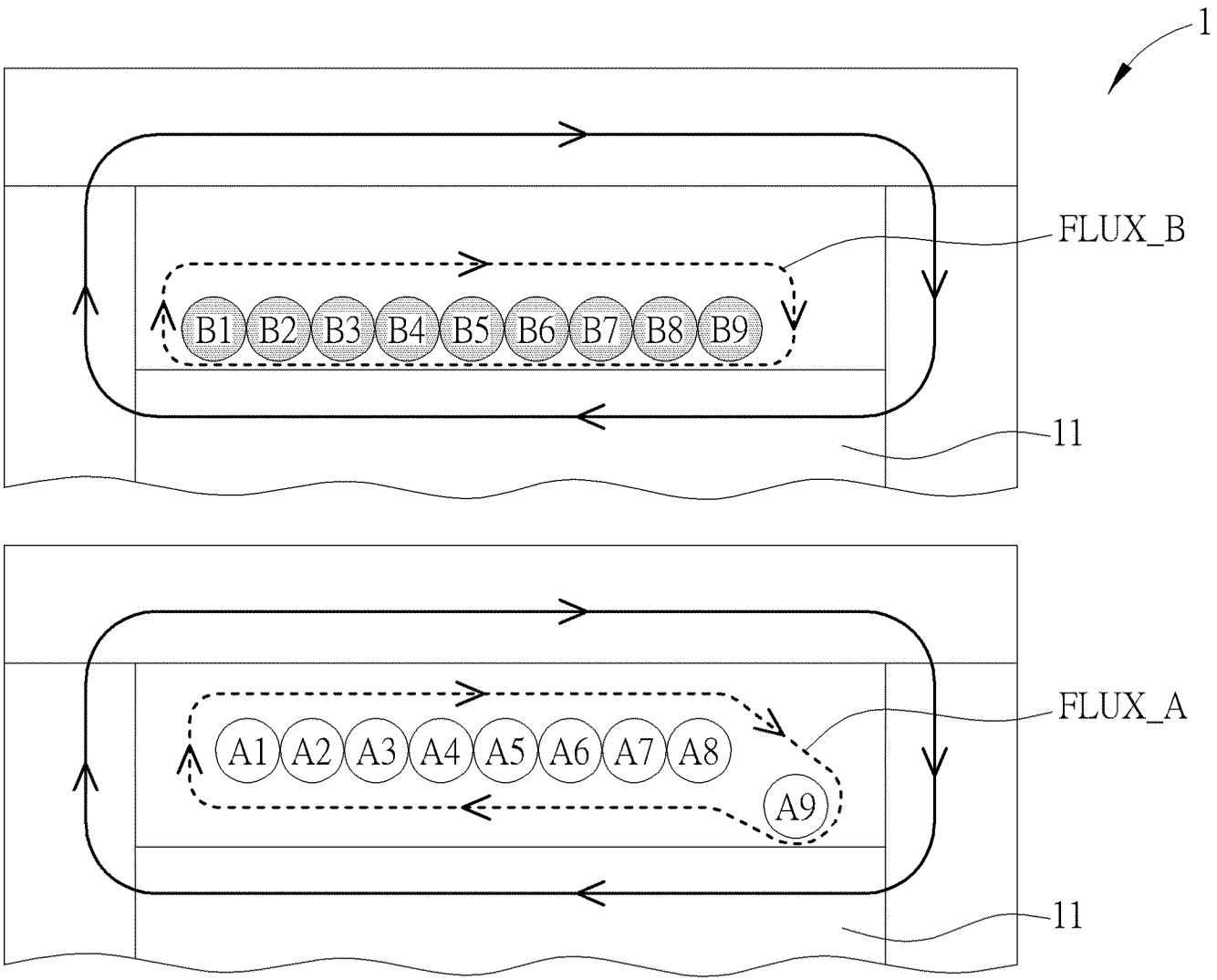
FIG. 1C PRIOR ART
FIG. 1C illustrates flux routes of the common mode filter of FIG. 1A.
Figure 1D:
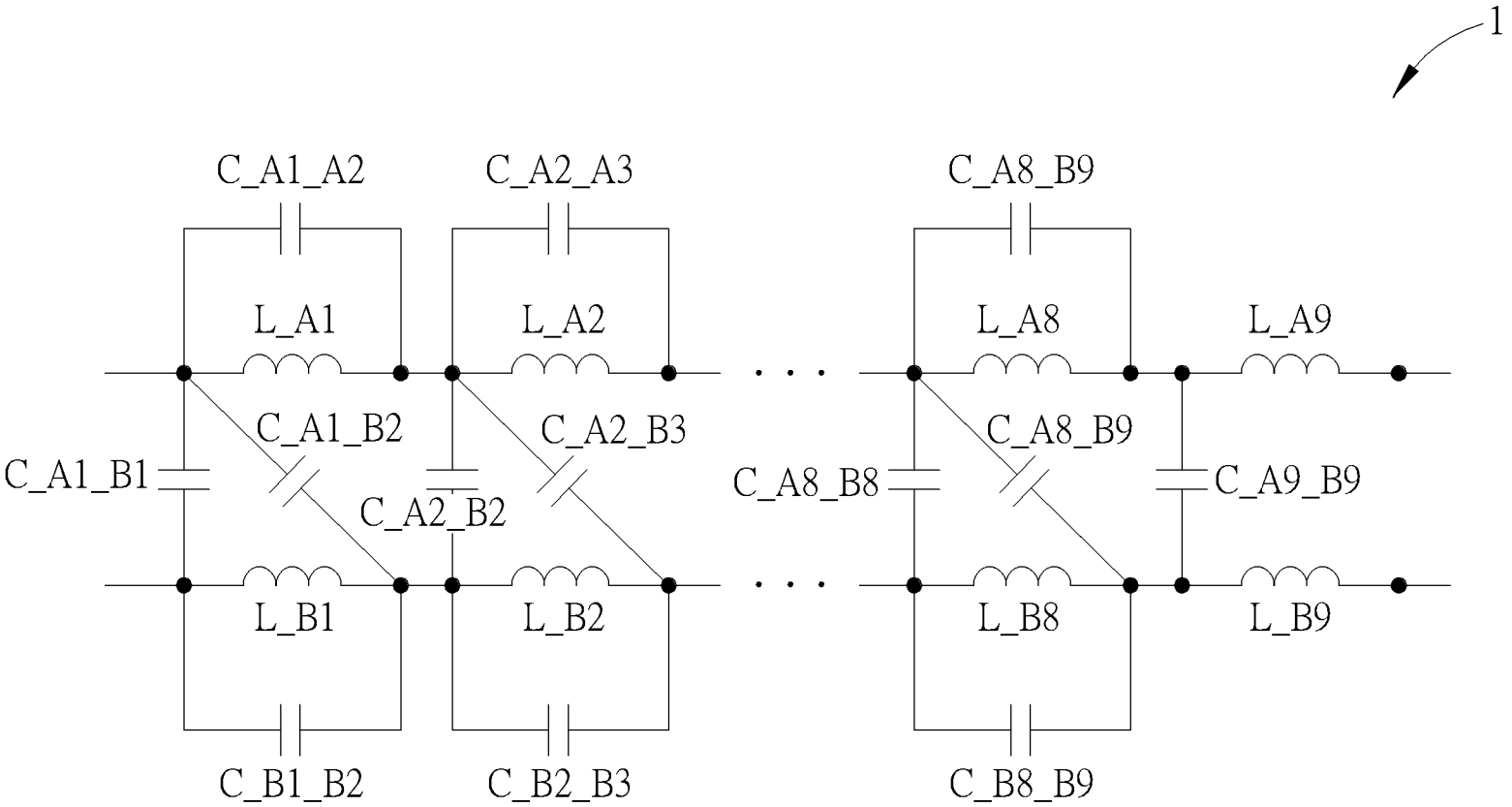
FIG. 1D PRIOR ART
FIG. 1D illustrates an equivalent circuit diagram of the common mode filter of FIG. 1A.
Figure 2C:
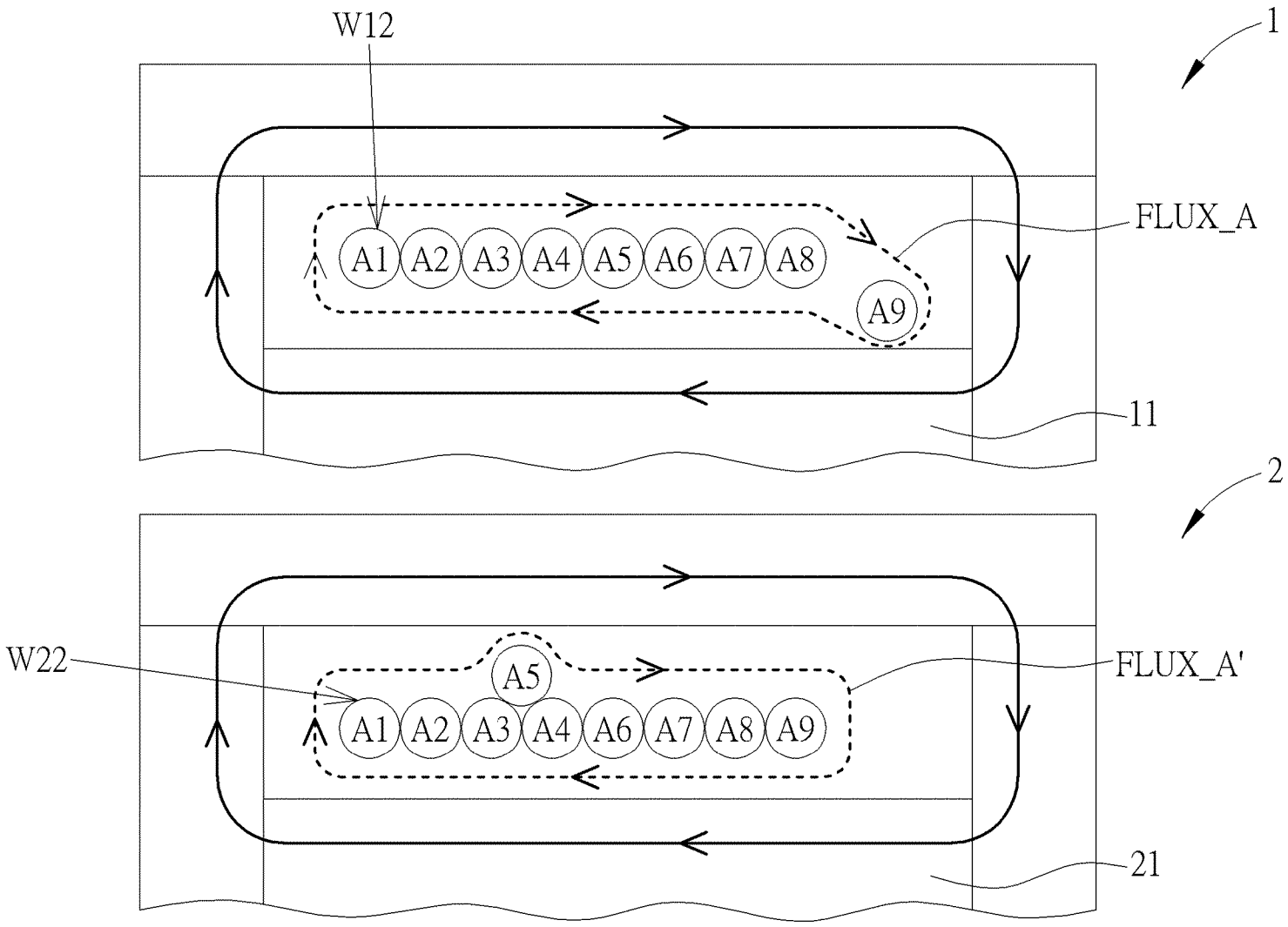
FIG. 2C illustrates flux routes of the common mode filter of FIG. 2A.

FIG. 2C illustrates magnetic flux routes of the outer coils of the common mode filters 1 and 2. As regarding the minor part of magnetic fluxes. The outer turns A1-A9 wound by the wire W12 induces a minor part of magnetic flux along route FLUX_A, and the outer turns A1-A9 wound by the wire W22 induces a minor part of magnetic flux along route FLUX_A'. As observed from FIG. 2C, the circumference of the route FLUX_A' is shorter than the circumference of the route FLUX_A, and thus the induced magnetic flux along route FLUX_A' is greater than that induced along route FLUX_A as shown in FIG. 1C. As a result, the increment of magnetic flux with flux route FLUX_A' makes the inductances of the two wires to be more balanced, and the corresponding coupling current is also decreased to mitigate the characteristic of mode conversion to improve signal-to-noise ratio and error rate during signal processing.

Figure 2D:
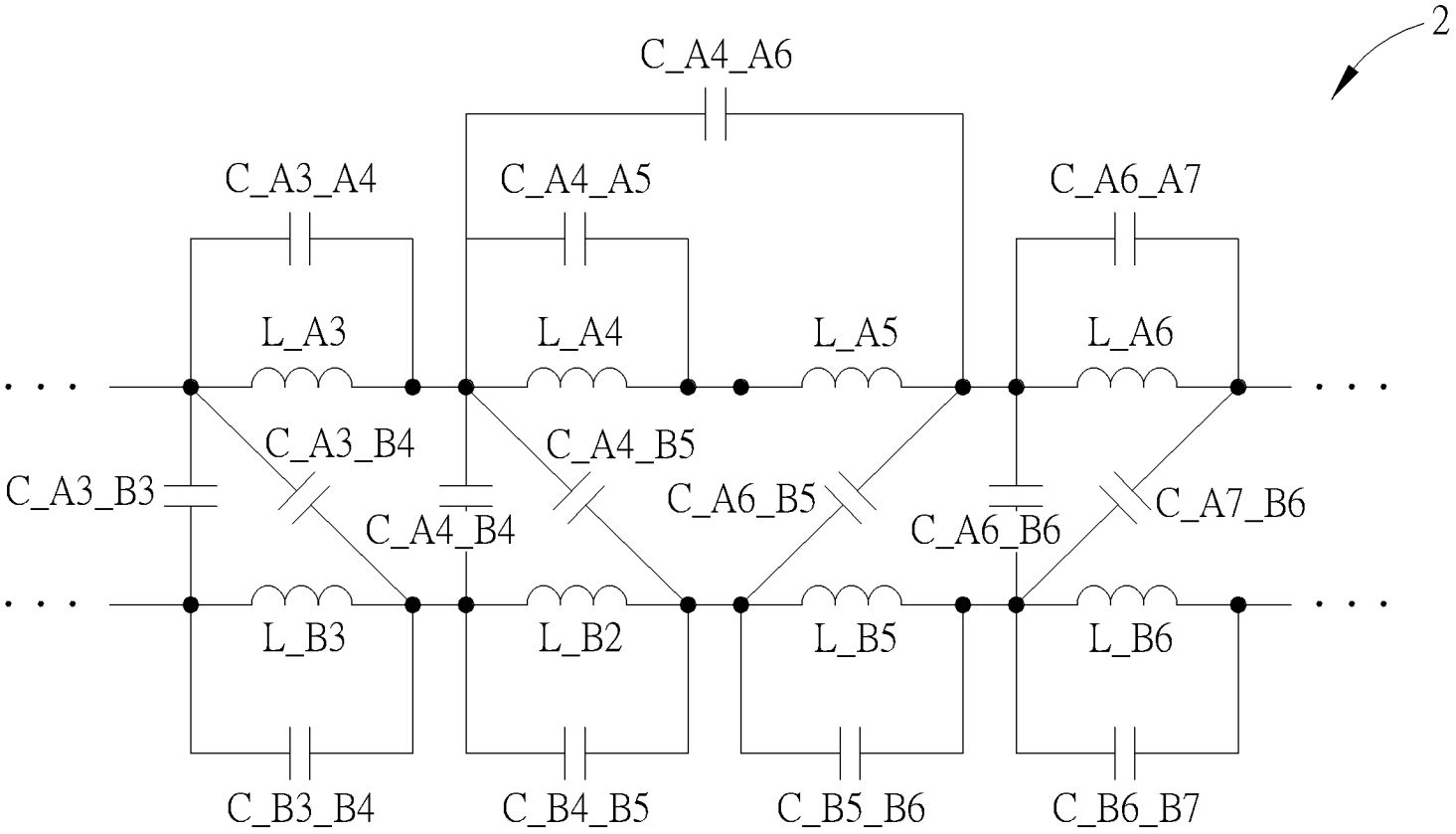
FIG. 2D illustrates an equivalent circuit diagram of the common mode filter of FIG. 2A.

FIG. 2D illustrates an equivalent circuit diagram of the common mode filter 2. There are distributed capacitances C_A(i−1)_Bi and C_A(j+1)_Bj produced by the outer turns A1-AM and the inner turns B1-BM, wherein 1≤i−1≤N and N≤j+1≤M. For example, given that M=9 and N=5, the distributed capacitances C_A(i−1)_Bi includes C_A1_B2, C_A2_B3, C_A3_B4 and C_A4_B5, and the distributed capacitances C_A(j+1)_Bj includes C_A6_B5, C_A7_B6, C_A8_B7 and C_A9_B8.

Coupling currents produced by the distributed capacitances C_A(i−1)_Bi and C_A(j+1)_Bj cause phase shifts to the input signal, wherein the phase shift is associated with a difference between the serial numbers of the inner turn and the outer turn. For example, the phase shifts respectively produced by the distributed capacitances C_A1_B2, C_A2_B3, C_A3_B4 and C_A4_B5 are with a same value and a same direction, which may be respectively marked with "−1" and marked with "−4" in total. While the phase shifts produced by the distributed capacitances C_A6_B5, C_A7_B6, C_A8_B7 and C_A9_B8 are with the same value and another same direction, which may be respectively marked with "+1" and marked with "+4" in total. Therefore, a total phase shift produced by the distributed capacitances C_A1_B2, C_A2_B3, C_A3_B4, C_A4_B5, C_A6_B5, C_A7_B6, C_A8_B7 and C_A9_B8 is zero (i.e., the sum of the phase shifts marked with "+4" and "−4" equals zero).

As a result, a total distributed capacitances of the common mode filter 2 may be reduced due to the cancellation (or compensation) between the balanced distributed capacitances C_A(i−1)_Bi and C_A(j+1)_Bj. Therefore, the mode conversion characteristics of the common mode filter 2 may be reduced to improve signal-to-noise ratio and error rate during signal processing.

In one embodiment, the total phase shift produced by the inner turns and the outer turns is associated with a sum of differences between the serial numbers of each of the inner turn and the outer turn, which is denoted as follows.

$$\text{Sum} = \sum_{i,j=1}^{M} (i - j)$$

If the inner turn and the outer turn is not completely coupled, the difference is multiplexed with a coupling proportion of the inner turn and the outer turn, for example, the difference is marked with "−1*0.5" if the inner turn and the outer turn is half coupled.

The mode conversion characteristic of the common mode filter 2 is effectively reduced if the sum of phase shift is substantially zero or smaller than an absolute tolerance range. In one embodiment, the tolerance range is (M−2), M≥4, and M is the number of the inner turns or the outer turns.

In one embodiment, the mode conversion characteristic of the common mode filter is effectively reduced if an absolute inductance difference is smaller than 1% of average inductance generated by the wires W21 and W22, which is denoted as follows.

$$\frac{|L_{W22} - L_{W21}|}{Avg.\ (L_{W21}, L_{W22})} < 1\%$$

In short, the common mode filter 2 with the at least one cross turn is capable of balancing the induced inductance and the distributed capacitance to reduce the mode conversion characteristics to improve signal-to-noise ratio and error rate during signal processing. Those skilled in the art may make modifications and alterations accordingly, which is not limited.

Figure 3:
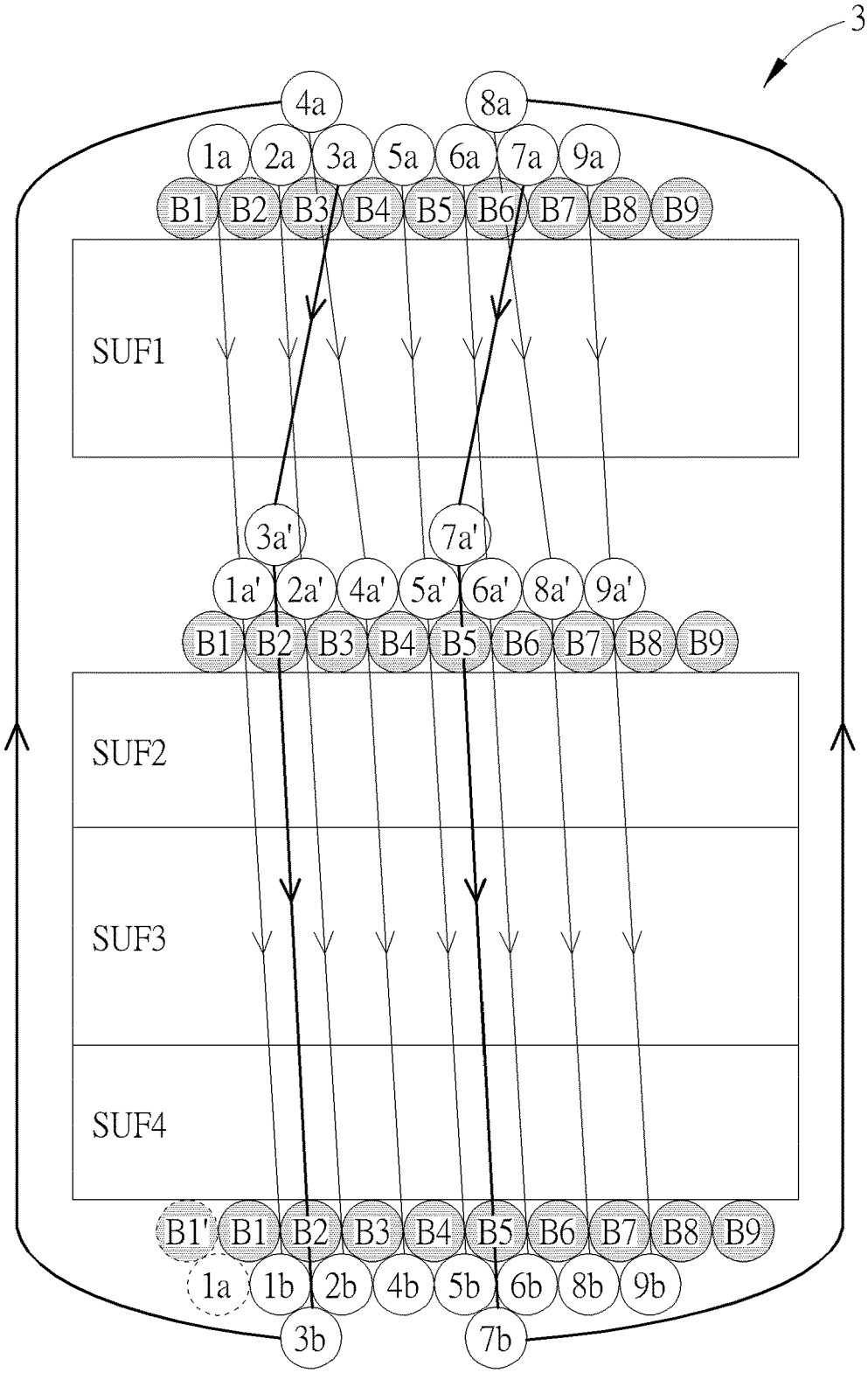
FIG. 3 to FIG. 8 illustrates a cross-sectional view of a common mode filter according to various embodiments of the present invention, respectively.

FIG. 3 illustrates a cross-sectional view of a common mode filter 3 according to another embodiment of the present invention. In this embodiment, the at least one cross turn includes two outer turns of the outer coil and the number of the plurality of inner turns or outer turns is odd, wherein a difference of serial number between one of the at least one cross turn and an initial turn of the outer coil is substantially equal to a difference of serial number between another one of the at least one cross turn and a last turn of the outer coil. Note that an inlet portion B1' of the inner coil and an inlet portion 1*a* of the outer coil are denoted with dashed pattern.

For example, the at least one cross turn includes the outer turns A3 and A7 and the number M of the inner turns of the inner coil (or the outer turns of the outer coil) is nine (M=9), wherein a difference of serial number between the outer turn A3 and the initial turn A1 is substantially equal to a difference of serial number between the outer turn A7 and the last turn A9 (i.e., 2).

Figure 4:
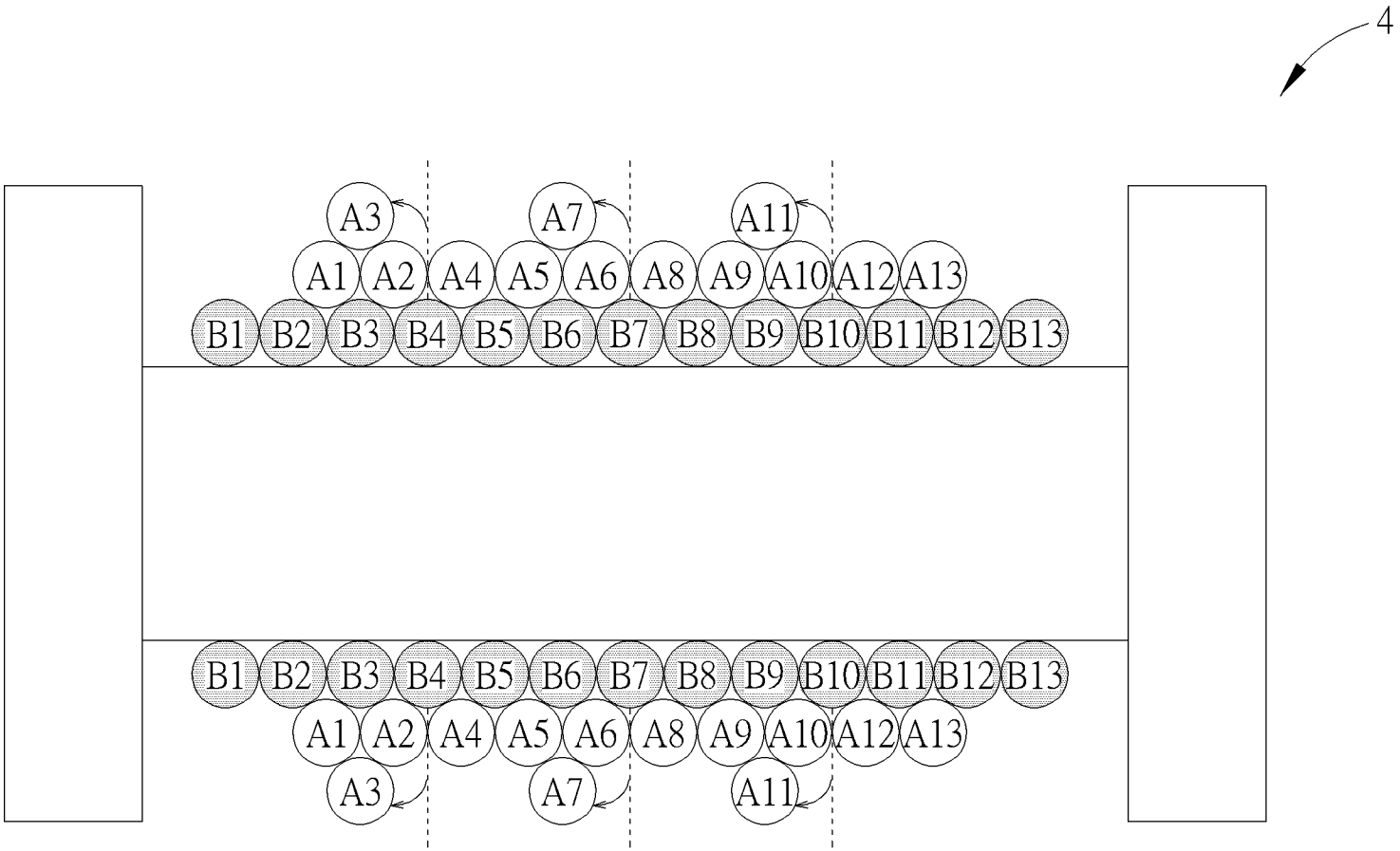

FIG. 4 illustrates a cross-sectional view of a common mode filter 4 according to another embodiment of the present invention. In this embodiment, the at least one cross turn includes three outer turns and the number of the plurality of inner turns or outer turns is odd, wherein three or more of the at least one cross turn are with equal differences of serial number.

For example, the at least one cross turn includes the outer turns A3, A7 and A11 of the outer coil and the number M of the inner turns or outer turns is thirteen (M=13), wherein the difference of serial number between the outer turns A3 and A7 is four, and the difference of serial number between the outer turns A7 and A11 is also four.

Figure 5:
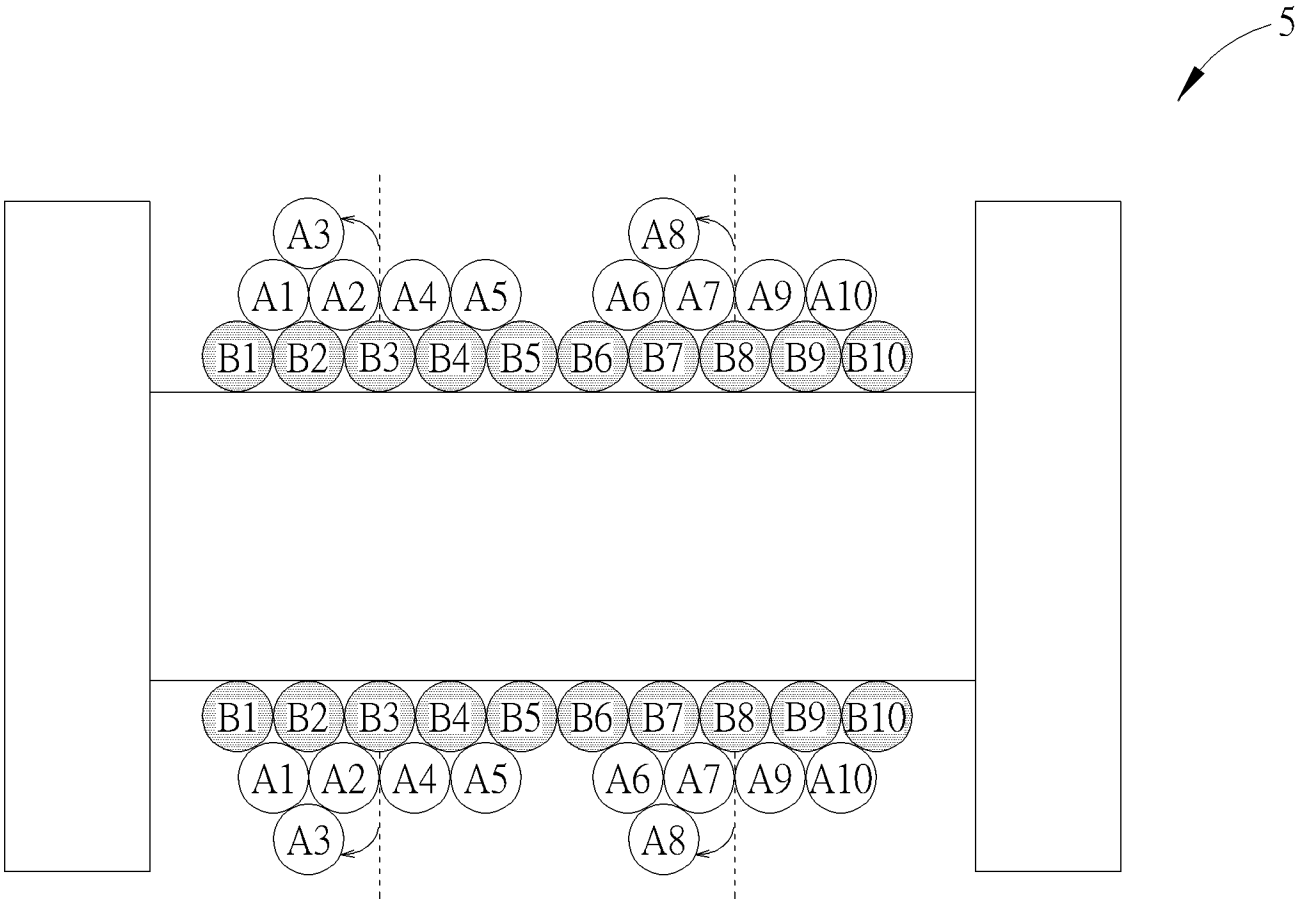

FIG. 5 illustrates a cross-sectional view of a common mode filter 5 according to another embodiment of the present invention. In this embodiment, if the sum of the plurality of outer turns is even, the at least one cross turn comprises a N-th outer turn and a J-th turn of the outer coil, $$N < \left(\frac{M}{2}\right) < J < M,$$

and M is the sum of the plurality of outer turns. Given that M/2=K, and a K-th turn of the outer coil is not adjacent to (K+1)th turn of the outer coil.

For example, given that N=3, J=8, M=10, and K=5, the outer turn A5 is not adjacent to the outer turn A6 of the outer coil. From another point of view, the outer coil including the outer turns A1-A10 may be divided into a first sub-coil including the outer turns A1-A5 and a second sub-coil including the outer turns A6-A10. The outer turn A3 being the cross turn is the middle of the first sub-coil, and the outer turn A8 being the cross turn is the middle of the second sub-coil, which makes both of the total distributed capacitances of the first and second sub-coils to be balanced.

Figure 6:
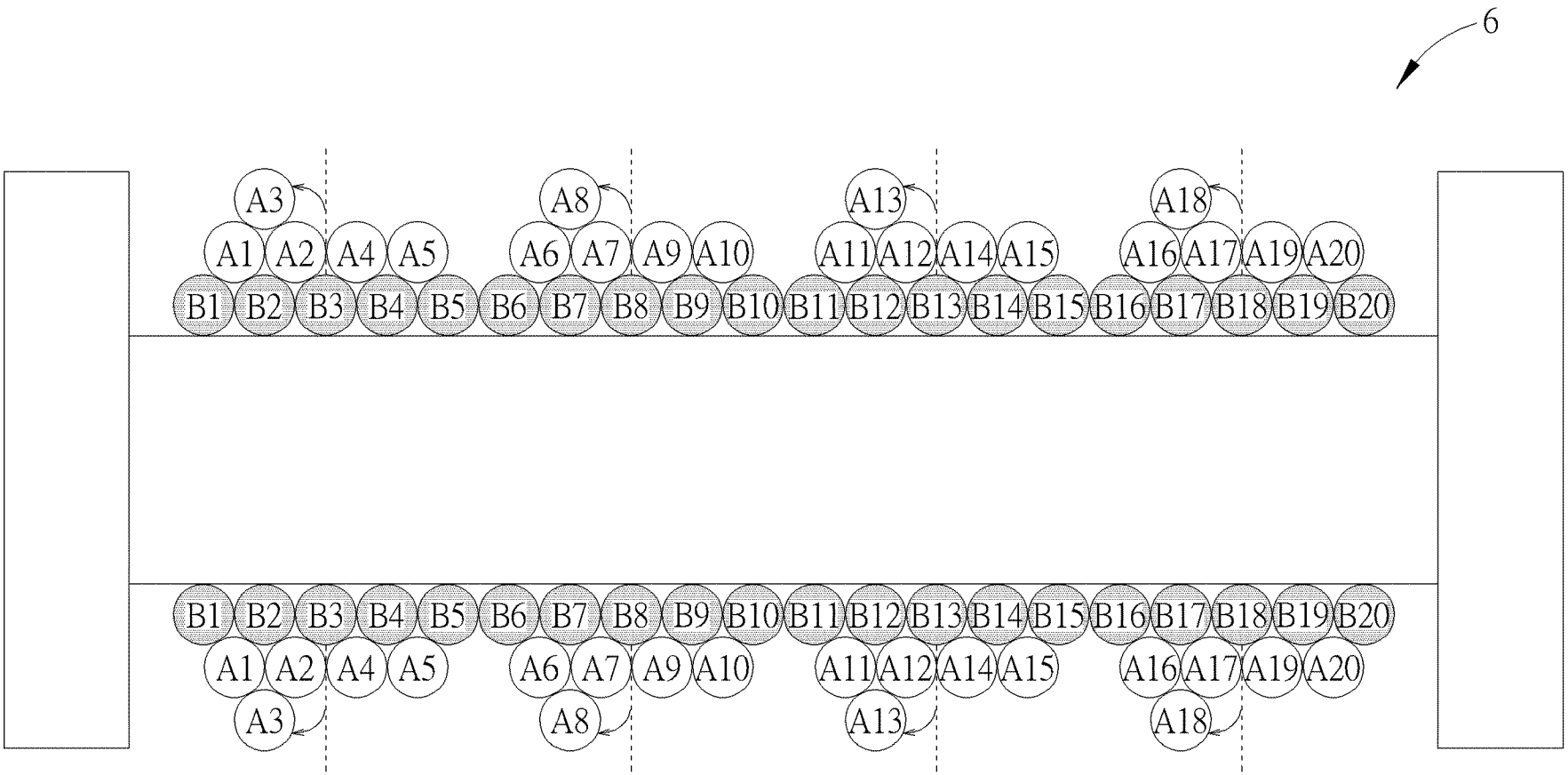

FIG. 6 illustrates a cross-sectional view of a common mode filter 6 according to another embodiment of the present invention. In this embodiment, given that the sum M of the plurality of turns of the outer coil (or inner coil) is even, and the number of the at least one cross turn is also even.

For example, given that M=20, and the number of the at least one cross turn is four. The outer coil including the outer turns A1-A20 may be divided into four sub-coils including the outer turns A1-A5, A6-A10, A11-A15 and A16-A20, and the cross turn A3, A8, A13 or A18 is respectively the middle turn of each of the sub-coils, which makes both of the total distributed capacitances of the four sub-coils to be balanced.

Figure 7:
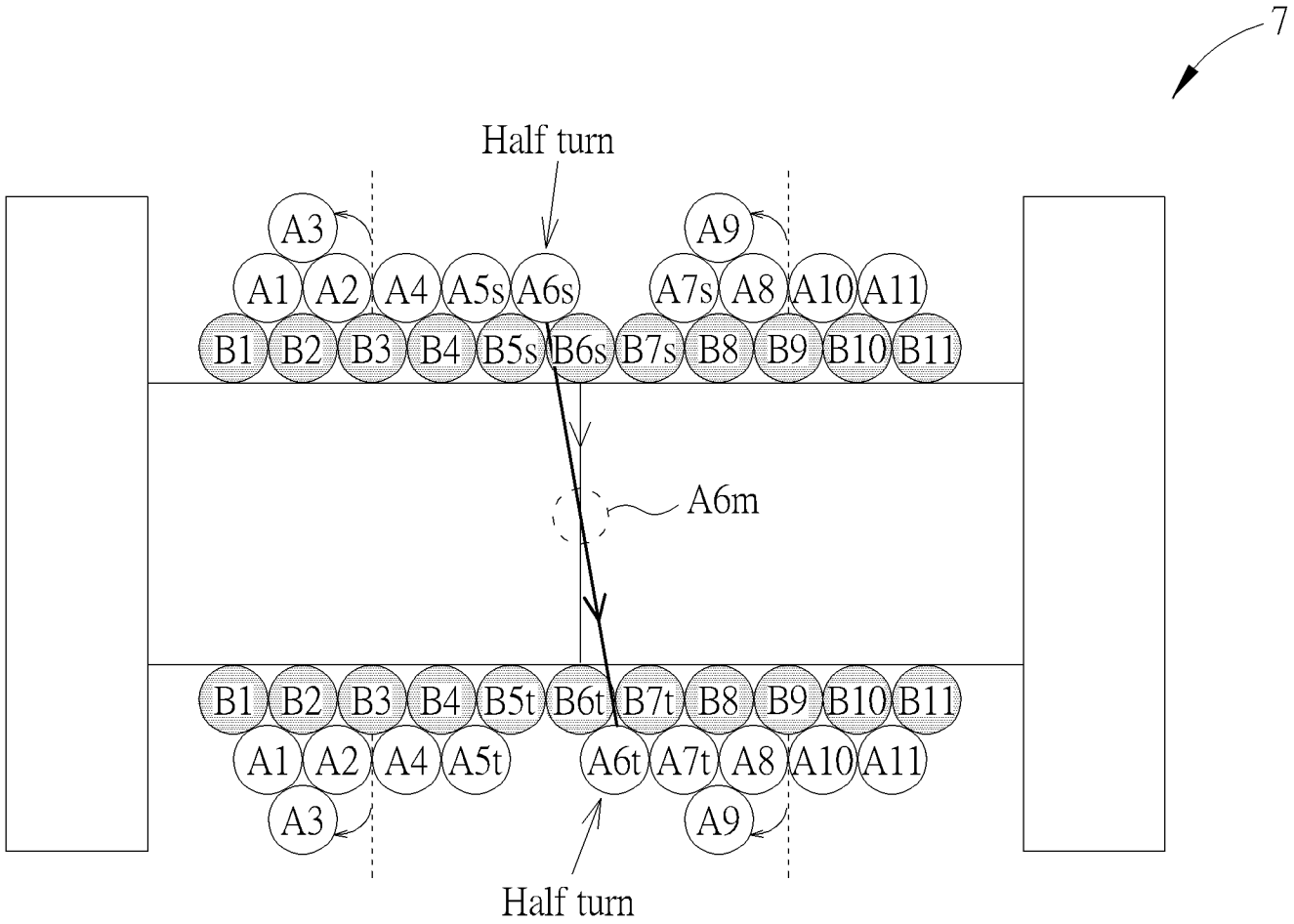

FIG. 7 illustrates a cross-sectional view of a common mode filter 7 according to another embodiment of the present invention. In this embodiment, given that the sum of the plurality of inner turns or outer turns is odd and a number of the at least one cross turn is even. For example, given that M=11, and the number of the at least one cross turn is two.

A difference of serial number between one of the at least one cross turn and an initial turn of the outer coil is substantially equal to a difference of serial number between another of the at least one cross turn and a last turn of the outer coil. For example, a difference of serial number between the cross turn A3 and the initial turn A1 of the outer coil is substantially equal to a difference of serial number between the cross turn A9 and a last turn A11 of the outer coil (i.e., 2).

The K-th turn of the outer coil includes a first portion adjacent to (K−1)th turn of the outer coil and a second portion adjacent to (K+1)th turn of the outer coil, wherein K is an integer no greater than the number of the plurality of inner turns. The first portion includes one end connected to the (K−1)th turn of the outer coil and adjacent to the (K−1)th and K-th turns of the plurality of inner turns, and another end adjacent to K-th turn of the plurality of inner turns. The second portion includes one end connected to the first portion and adjacent to K-th turn of the plurality of inner turns, and another end adjacent to the K-th and (K+1)th turns of the plurality of inner turns and connected to (K+1)th turn of the outer coil.

For example, given that K=6, the outer turn A6 of the outer coil includes the first portion A6*s*A6*m* adjacent to the outer turn A5 of the outer coil and a second portion A6*m*A6*t* adjacent to outer turn A7 of the outer coil. The first portion A6*s*A6*m* includes one end A6*s* connected to the outer turn A5 of the outer coil and adjacent to the inner turns B5 and B6 of the inner coil, and another end A6*m* adjacent to the inner turn B6 of the inner coil. The second portion A6*m*A6*t* includes one end A6*m* connected to the first portion A6*s*A6*m* and adjacent to the inner turn A7 of the inter coil, and another end A6*t* adjacent to the inner turns B6 and B7 of the inner coil and connected to the outer turn A7 of the outer coil.

Note that the outer turn A6 is across the inner turn B6 at a middle point of outer turn A6, which makes the outer turn A6 is half coupled with the inner turn B5 and also half coupled with the inner turn B7. Therefore, the distributed capacitances produced by the outer turn A6 and the inner turns B5 and B7 may be marked with "−0.5" and "+0.5" to be balanced in total.

Figure 8:
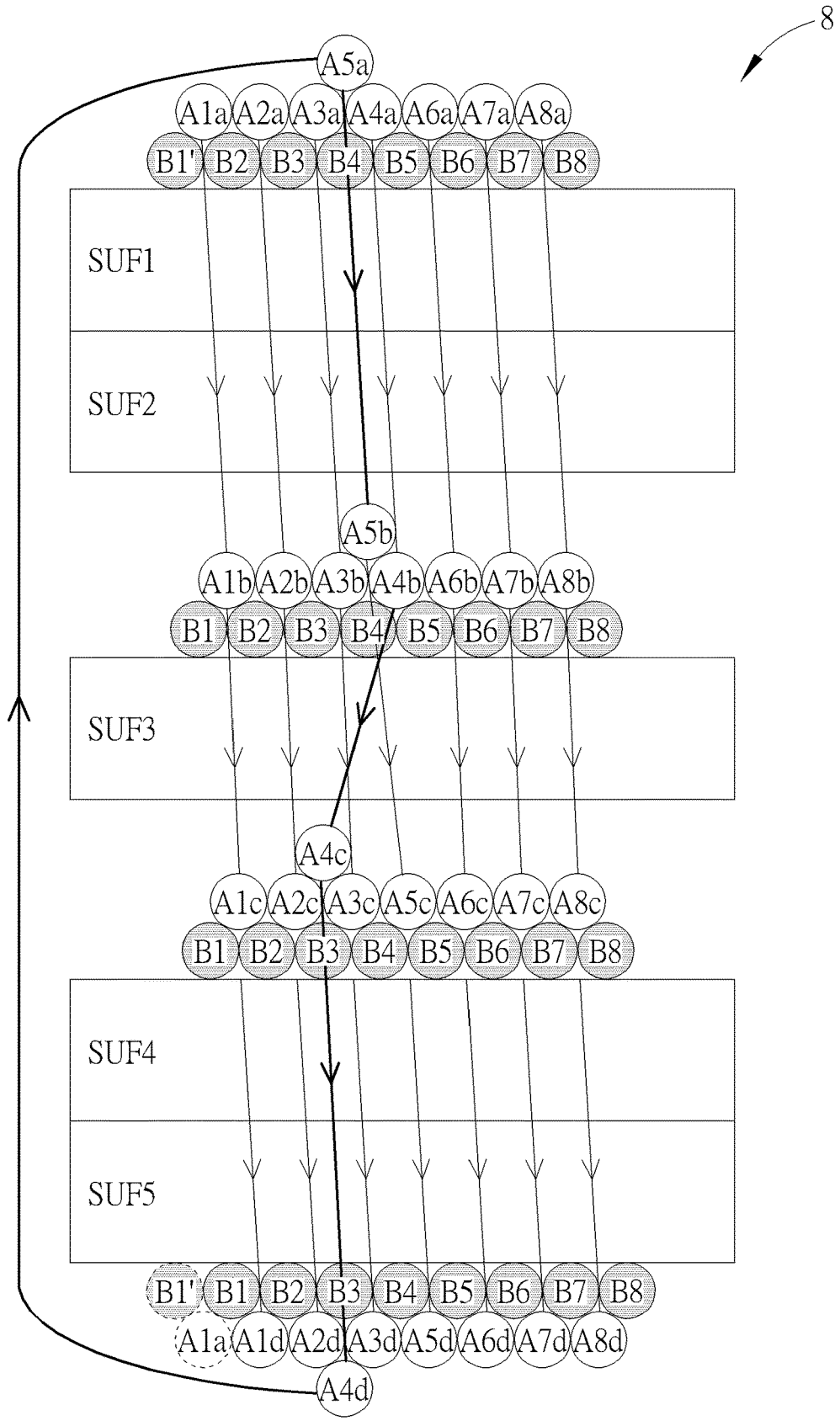

FIG. 8 illustrates a cross-sectional view of a common mode filter 8 according to another embodiment of the present invention. In this embodiment, given that the sum M of the plurality of turns of the outer coil (or inner coil) is even, the at least one cross turn includes half of a K-th turn and half of a (K+1)th turn of the outer coil, and K=M/2. For example, given that M=8, K=4, and the at least one cross turn includes half of the fourth turn A4 and half of the fifth turn A5 of the outer coil. Note that an inlet portion B1' of the inner coil and an inlet portion A1*a* of the outer coil are denoted with dashed pattern.

The K-th turn of the outer coil includes a first portion connected to the (K−1)th turn of the outer coil, a second portion across the (K−1)th turn of the outer coil, and a third portion adjacent to the (K−2)th and (K−1)th turns of the outer coil and connected to the (K+1)th outer turn of the outer turn. The (K+1)th turn of the outer coil includes a first portion adjacent to the (K−1)th and K-th turns of the outer coil and connected to the K-th outer turn of the outer turn, a second portion across the K-th turn of the outer coil, and a third portion adjacent to the K-th and (K+1)th turns of the inner coil and connected to the (K+2)th turn of the outer coil.

For example, the outer turn A4 of the outer coil includes a first portion A4*a*A4*b* connected to the outer turn A3 of the outer coil, a second portion A4*b*A4*c* across outer the turn A3 of the outer coil, and a third portion A4*c*A4*d* adjacent to the outer turns A2 and A3 of the outer coil and connected to the outer turn A5 of the outer turn. The outer turn A5 of the outer coil includes a first portion A5*a*A5*b* adjacent to the outer turns A3 and A4 of the outer coil and connected to the outer turn A4 of the outer turn, a second portion A5*b*A5*c* across the outer turn A4 of the outer coil, and a third portion A5*c*A5*d* adjacent to the inner turns B4 and B5 and connected to the outer turn A6.

Note that a length of the third portion A4*c*A4*d* of the outer turn A4 is equal to a length of the first portion A5*a*A5*b* of the outer turn A5, which makes a coupling proportion of the outer turn A4 and the inner turn B5 to be balanced with a coupling proportion of the outer turn A5 and the inner turn B4. Therefore, the distributed capacitances produced by the outer turns A4 and A5 and the inner turns B4 and B5 may be balanced.

To sum up, the common mode filter with the at least one cross turn of the outer coil is capable of balancing the induced inductance and the distributed capacitance to reduce the mode conversion characteristics to improve signal-to-noise ratio and error rate during signal processing.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A common mode filter, comprising:

a winding core;

an inner coil formed of an inner wire wound around the winding core, and comprising a plurality of inner turns; and an outer coil formed of an outer wire wound around the inner coil, and comprising a plurality of outer turns and at least one cross turn, wherein a sum of the plurality of outer turns and the at least one cross turn is equal to a number of the plurality of inner turns;

wherein the at least one cross turn comprises a N-th turn of the outer coil, wound across a (N−1)th turn of the outer coil, and adjacent to two of the plurality of outer turns of the outer coil;

wherein N is an integer not less than 3 and not greater than the number of the plurality of inner turns.

2. The common mode filter of claim 1, wherein the at least one cross turn comprises:

a first portion across the (N−1)th turn of the outer coil, having:

one end connected to the (N−1)th turn of the outer coil and adjacent to the two of the inner turns; and another end adjacent to (N−1)th and (N−2)th turns of the outer coil and not adjacent to the plurality of inner turns; and a second portion parallel to the (N−1)th and (N−2)th turns of the outer coil, not adjacent to the inner turns, having:

one end connected to the first portion; and another end connected to(N+1)th turn of the outer coil.

3. The common mode filter of claim 1, wherein the N-th turn of the outer coil is a middle turn of the outer coil if the sum of the plurality of outer turns of the outer coil is odd.

4. The common mode filter of claim 1, wherein when the sum of the plurality of turns of the outer coils is odd, the at least one cross turn further comprises a J-th turn of the outer coil, where $$N < \left(\frac{M+1}{2}\right) < J < M,$$

and M is the sum of the plurality turns of the outer coil.

5. The common mode filter of claim 4, wherein (M+1)/2=K, K-th turn is a middle turn of the all turns of the outer coil, and the K-th turn comprises:

a third portion adjacent to (K−1)th turn of the outer coil, having:

one end connected to the(K−1)th turn of the outer coil and adjacent to the (K−1)th and K-th turns of the plurality of inner turns; and another end adjacent to K-th turn of the plurality of inner turns; and a fourth portion adjacent to (K+1)th turn of the outer coil, having:

one end connected to the third portion and adjacent to K-th turn of the plurality of inner turns; and another end adjacent to the K-th and (K+1)th turns of the plurality of inner turns and connected to (K+1)th turn of the outer coil.

6. The common mode filter of claim 1, wherein when the sum of the plurality of turns of the outer coil is even, the at least one cross turn further comprises a J-th turn of the outer coil, where $$N < \left(\frac{M}{2}\right) < J < M,$$

and M is the sum of the plurality of turns of the outer coil.

7. The common mode filter of claim 6, wherein a K-th turn being half of the sum of plurality of turns of the outer coil is not adjacent to (K+1)th turn of the outer coil.

8. The common mode filter of claim 7, wherein the K-th turn of the outer coil is wound across K-th and (K+1)th turns of the inner coil.

9. The common mode filter of claim 1, wherein when the sum of the plurality of turns of the outer coil is even, and the N-th turn of the outer coil comprises:

a fifth portion parallel and adjacent to (N−1)th turn of the outer coil and N-th and (N+1)th turns of the inner coil;

a sixth portion connected to the fifth portion and wound across (N−1)th turn of the outer coil, having:

one end adjacent to (N−1)th turn of the outer coil and N-th and (N+1)th turns of the inner coil; and another end adjacent to (N−1)th and (N−2)th turns of the outer coil, and not adjacent to the plurality of inner turns;

a seventh portion parallel and adjacent to the (N−1)th and (N−2)th turns of the outer coil, and not adjacent to the plurality of inner turns, having:

one end connected to the sixth portion; and another end connected to the (N+1)th turn of the outer coil.

10. The common mode filter of claim 9, wherein the (N+1)th turn of the outer coil comprises:

an eighth portion parallel and adjacent to the N-th and (N+1) th turns of the outer coil, and not adjacent to the plurality of inner turns; and a ninth portion wound across the sixth portion of the (N+1) th turns of the inner coil.

11. The common mode filter of claim 1, wherein the winding core comprises a pair of flanges, and a minimum distance between the inner coil and the pair of flanges is smaller than a minimum distance between the outer coil and the pair of flanges.

12. The common mode filter of claim 1, wherein a difference of serial number between one of the at least one cross turn and an initial turn of the outer coil is substantially equal to a difference of serial number between another of the at least one cross turn and a last turn of the outer coil.

13. The common mode filter of claim 1, wherein three or more of the at least one cross turn are with equal differences of serial number.

14. The common mode filter of claim 1, wherein a total distributed capacitance generated by the inner coil and the outer coil is associated with a summation of differences between the serial numbers of each turns of the inner coil and the outer coil, the total distributed capacitance is within an absolute tolerance range, and the absolute tolerance range is substantially equal to (M−2); wherein M≥4, and M is the sum of the plurality turns of the outer coil.

15. The common mode filter of claim 1, wherein the N-th turn of the outer coil comprises a back-crossing portion, the back-crossing portion contacts with a surface of the (N−1)th turn of the outer coil, and the surface of the (N−1)th turn of the outer coil is away from the inner coil.

16. The common mode filter of claim 1, wherein the plurality of outer turns comprises a (N+1)th turn of the outer coil, the (N+1)th turn of the outer coil comprises a front-crossing portion, the front-crossing portion wounds across the N-th turn of the outer coil and contacts with a surface of the N-th turn of the outer coil, and the surface of the N-th turn of the outer coil is away from the inner coil.

17. A common mode filter, comprising:

a winding core;

an inner coil formed of an inner wire wound around the winding core, and comprising a plurality of inner turns; and an outer coil formed of an outer wire wound around the inner coil, and comprising a plurality of outer turns and at least one cross turn, wherein a sum of the plurality of outer turns and the at least one cross turn is equal to a number of the plurality of inner turns;

wherein the at least one cross turn comprises a N-th turn of the outer coil, wound across one of the plurality of outer turns of the outer coil, and adjacent to two of the plurality of outer turns of the outer coil;

wherein the N-th turn comprises a back-crossing portion, the back-crossing portion contacts with a surface of the outer turn, and the surface of the outer turn is away from the inner coil;

wherein N is an integer not less than 3 and not greater than the number of inner turns.

18. A common mode filter comprising:

a winding core;

an inner coil formed of an inner wire wound around the winding core, and comprising a plurality of inner turns; and an outer coil formed of an outer wire wound around the inner coil, and comprising a plurality of outer turns and at least one cross turn, wherein a sum of the plurality of outer turns and the at least one cross turn is equal to a number of the plurality of inner turns;

wherein the at least one cross turn is adjacent to two of the plurality of outer turns that are wound before the at least one cross turn is wound.

19. The common mode filter of claim 18, wherein the at least one cross turn comprises:

a first portion across one of the plurality of outer turns that is wound before the at least one cross turn is wound, having:

one end connected to one of the plurality of outer turns that is wound before the at least one cross turn is wound and adjacent to the two of the inner turns; and another end adjacent to two of the plurality of outer turns that is wound before the at least one cross turn is wound and not adjacent to the inner turns; and a second portion parallel to two of the plurality of outer turns that is wound before the at least one cross turn is wound, not adjacent to the inner turns, having:

one end connected to the first portion; and another end connected to one of the plurality of outer turns that is wound after the at least one cross turn is wound.

20. The common mode filter of claim 18, wherein the at least one cross turn comprises a back-crossing portion, the back-crossing portion contacts with a surface of the outer turn, and the surface of the outer turn is away from the inner coil.

* * * * *